United States Patent [19]

Hultberg et al.

[11] Patent Number: 4,793,104

[45] Date of Patent: Dec. 27, 1988

[54] GUIDE FOR LAYING GLASS BLOCKS

[75] Inventors: Jeffrey A. Hultberg, Elk Grove Village; Richard A. Riedel, Park Ridge, both of Ill.

[73] Assignee: Delberg, Inc., Park Ridge, Ill.

[21] Appl. No.: 206,815

[22] Filed: Jun. 15, 1988

[51] Int. Cl.[4] ..... E04C 5/16

[52] U.S. Cl. ..... 52/121.3; 52/306; 52/442; 52/687

[58] Field of Search ..... 52/687, 306, 127.3, 52/307, 308, 442

[56] References Cited

U.S. PATENT DOCUMENTS

| | | | |
|---|---|---|---|
| 790,009 | 5/1905 | Streeter | 52/442 |
| 2,106,177 | 1/1938 | Hultquist | 52/308 |
| 2,227,842 | 1/1941 | Polivka | 52/308 |
| 2,930,135 | 3/1960 | Rodtz, Sr. | 52/127.3 |
| 3,196,581 | 6/1965 | Castelli | 52/127.3 |
| 3,420,031 | 1/1969 | Castelli | 52/127.3 |
| 3,501,877 | 3/1970 | White | 52/127.3 |
| 3,788,025 | 1/1974 | Holmes | 52/687 X |
| 4,719,735 | 1/1988 | Flemming, Jr. et al. | 52/306 |

OTHER PUBLICATIONS

PC Glass Block, Pittsburg Corning Corp., 1948, pp. 14–17.

Accu-Speed glass block Connectors, Mayer Equity Inc.

*Primary Examiner*—David A. Scherbel
*Assistant Examiner*—Lan Mai
*Attorney, Agent, or Firm*—Richard W. Carpenter

[57] ABSTRACT

A one-piece guide adapted to be inserted into mortar, between recessed surfaces presented by opposing faces of adjacent glass blocks, to space and align them with respect in each other in the formation of a masonry structure. The guide comprises a relatively thin frame including longitudinal and transverse arms having joined to their free ends bodies that are spaced transversely from said each other a distance only slightly less than the width of said recessed face surfaces.

20 Claims, 1 Drawing Sheet

GUIDE FOR LAYING GLASS BLOCKS

BACKGROUND OF THE INVENTION

1. Field of the Invention

This invention relates to masonry construction and more particularly to a one-piece guide adapted to be inserted into mortar between recessed surfaces presented by opposing faces of adjacent glass blocks, to space and align the blocks with respect to each other in the formation of a masonry structure such as a glass block wall.

2. Description of Background Art

A background art search directed to the subject matter of this application and conducted in the United States Patent and Trademark Office disclosed the following U.S. Pat. Nos.: 4,334,397, 4,229,922, 4,190,999, 4,136,498, 4,114,337, 4,091,587, 3,641,731, 3,420,031, 3,374,589, 3,196,581, 3,183,629, 2,930,135, 2,797,495, 2,776,559, 2,543,716, 2,527,985, 2,483,560, 2,472,221, 2,325,653, 2,227,842, 2,227,228, 2,124,799, 2,123,225, 2,114,906, 2,106,177, 1,943,485, 1,932,275, 1,798,088, 803,559.

None of the patents uncovered in the search discloses a onepiece guide, for spacing and aligning glass blocks, that includes a frame having longitudinally and transversely extending arms interconnecting solid bodies that are spaced transversely from each other a distance only slightly less of the width of the opposing recessed surfaces in faces of adjacent glass blocks.

SUMMARY OF THE INVENTION

It is an object of the present invention to provide a simple one-piece guide adapted to be placed between adjacent glass blocks to space and align them with respect with each other in the formation of a masonry structure such as a wall.

A more specific object of the invention is a provision of a guide of the type described which includes a T-shaped or triangular frame having longitudinally and transversely extending arms joined at their free ends to solid bodies that are spaced transversely from each other a distance only slightly less than the width of opposing recessed surfaces presented by adjacent glass blocks.

These and other objects of the invention will be apparent from the examination of the following description and drawings.

It will be understood that, for purposes of clarity, certain elements may have been intentionally omitted from certain view where they are believed to be illustrated to better advantage in other views.

DESCRIPTION OF THE PREFERRED EMBODIMENT

Figure 4:
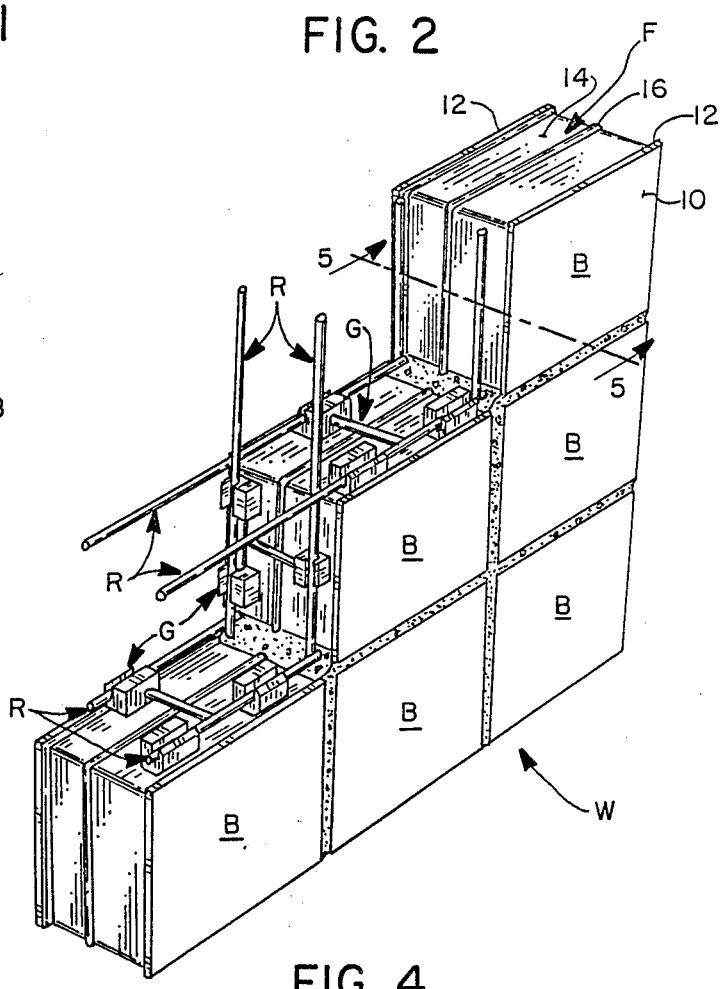
FIG. 4 is a fragmentary perspective view of a masonry structure, such as a glass block wall, illustrating the use of a guide embodying the present invention.

Turning now to the drawings for a better understanding of the invention, and particularly to FIG. 4, it will be seen that the spacing and aligning guide embodying features of the invention, and indicated generally at G, is shown as it is used in the formation of a masonry structure, such as a glass block wall indicated generally at W. The wall comprises a plurality of glass blocks B that are joined to each other by means of an adhesive compound, such as mortar M.

Figure 5:
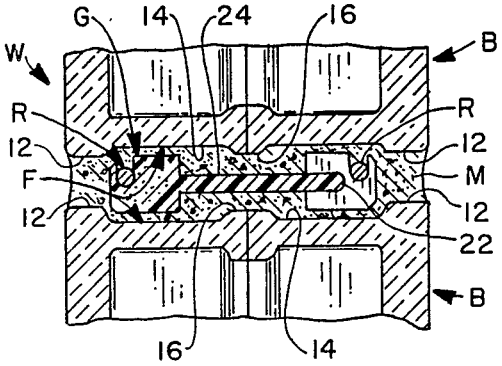
FIG. 5 is a fragmentary, transverse, sectional view taken on line 5—5 of FIG. 4.

As best seen in FIGS. 4 and 5, each glass block B presents a plurality of transversely extending faces 10 adapted to mate with related faces of adjacent blocks. Each face 10 includes a pair of side flanges 12 at opposite sides of the block that are spaced from each other by a recessed center surface 14. Surface 14 is relatively flat, except for a central ridge or bead 16 that is located at the juncture of the separate block halves and extends in a direction parallel to side flanges 12.

Turning now to FIG. 5, it will be seen that the novel guide G is adapted to be inserted into the mortar M between a pair of adjacent glass blocks B.

The guide G consists of a relatively simple, preferrably T-shaped frame 20 which includes a longitudinally extending arm 22 and a transversely extending arm 24 joined to a central portion of the longitudinal arm and extending normal thereto.

A pair of longitudinally spaced first and second spacer bodies 26 are integrally joined to opposite ends of longitudinal arm 22 while a third body 28, spaced transversely from the first and second bodies, is joined to the free end of the transverse arm 24.

The bodies are all aligned in the same direction, so that the first and second longitudinally spaced bodies 26 are joined at their ends to the opposite ends of longitudinal arm 22; whereas, the third transversely spaced body 28 is joined at its rear side to the free end of transverse arm 24.

Figure 1:
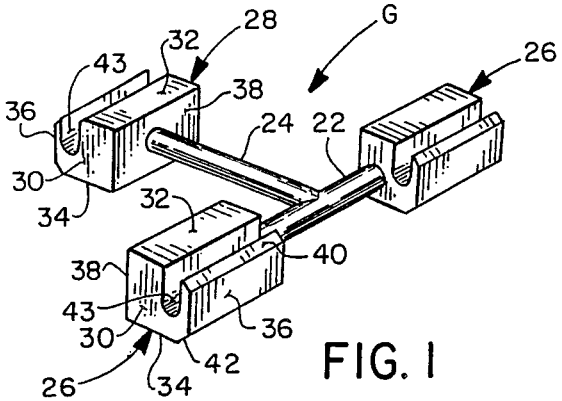
FIG. 1 is a perspective view of a spacing and aligning guide embodying features of the invention.
Figure 2:
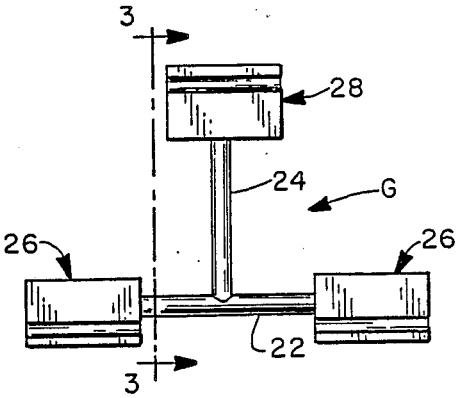
FIG. 2 is a top plan view of the structure illustrated in FIG. 1.
Figure 3:
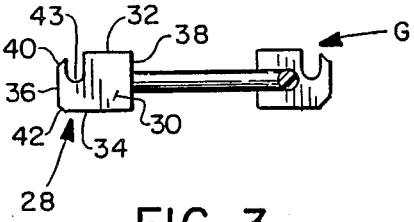
FIG. 3 is a transverse, vertical, sectional view taken on line 3—3 of FIG. 2.

As best seen in FIGS. 1 and 3, each of the bodies is preferrably a solid elongated block or parallelepipedon that includes a pair of flat end surfaces 30 and flat, rectangular upper, lower, front, and rear surfaces 32, 34, 36, and 38, respectively. The upper and lower surfaces are parallel to each other, as are the front and rear surfaces and the end surfaces.

The front side of each body also includes a pair of upper and lower angled surfaces 40 and 42, respectively, that slope from front surface 36 to upper and lower surfaces 32 and 34, respectively.

Each of the bodies also presents, forwardly of its upper surface, a longitudinally extending slot or groove 45 adapted to receive a portion of a steel reinforcing rod R, as best illustrated in FIGS. 4 and 5.

As best seen in FIG. 5, the spacing and aligning guide G is adapted to be inserted into the mortar M between opposing faces 10 of adjacent glass blocks B. It is essential that the entire guide be completely encompassed by mortar, so that no part of the guide is in direct contact with either of the glass blocks, and the opposing faces of the glass blocks are coated with an uninterrupted layer of mortar to provide a perfect bond.

As best seen in FIG. 5, the vertical dimension or thickness of the frame 20 is substantially less than that of the bodies to maximize the amount of mortar that can be placed between adjacent glass blocks and also to allow the frame to clear the central ridges 16 in the faces 10 of the glass blocks.

It should be noted that the sloping upper and lower surfaces 40 and 42 of the bodies allow the longitudinally spaced first and second bodies 26 to be spaced from the transversely spaced third body 28 the maximum distance between the side flanges 12 of the glass blocks. This provides for proper alignment and spacing, and still allows for a thin layer of mortar to be placed in the space between the corners of the bodies and the side flanges of the glass blocks.

Figure 6:
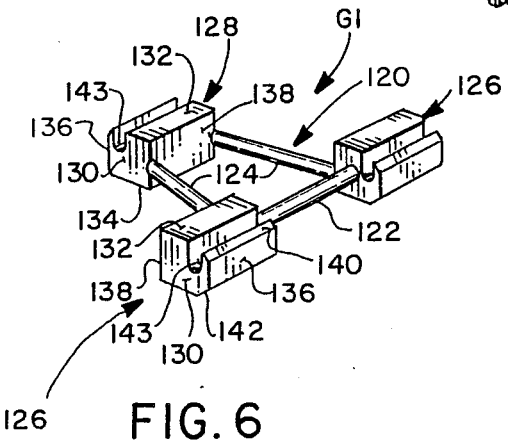
FIGS. 6 and 7 are views similar to FIGS. 1 and 2, respectively, but illustrate a slightly modified form of the invention.
Figure 7:
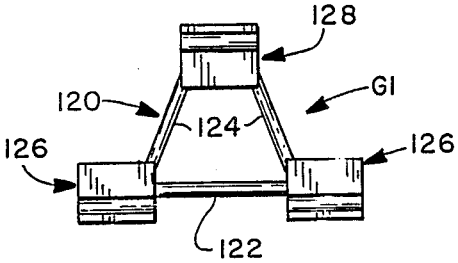

Turning now to FIGS. 6 and 7, it will be seen that a slightly modified form of the invention is shown. In these views portions of the structure that correspond to portions of the structure illustrated in previous views have been indicated by related numerals.

In this embodiment, the structure of each of the bodies 126 and 128 of guide G1 is identical to that of the bodies of the previously described embodiment. The difference between the embodiments lies in the structure of the frame 120, which is triangular in shape, rather than T-shaped, as in the case of the previously described embodiment.

The triangular frame 120 includes a longitudinally extending arm 122, which is joined at its opposite ends to the first and second longitudinally spaced bodies 126, and a pair of transverse arms 124 which extend from the rear surfaces of first and second longitudinally spaced bodies 126 to the rear surface of transversely spaced third body 128. The operation and function of guide G1 is exactly the same as that of the previously described embodiment of guide G.

Thus, it will be appreciated that in each embodiment the guide is designed and constructed to be inserted into the space between adjacent glass blocks in order to space an align them properly and thereby insure that a perfectly straight masonry wall can be formed.

What is claimed is:

1. A one-piece guide adapted to be inserted into an adhesive compound, such as mortar, between recessed surfaces of predetermined width presented by opposing faces of adjacent units, such as glass blocks, to space and align said units with respect to each other in the formation of a masonry structure, said guide comprising:

(a) a generally T-shaped frame including a longitudinal arm and a transverse arm joined at one end to a medial portion of said longitudinal arm;

(b) a pair of longitudinally spaced first and second bodies joined to opposite ends of said longitudinal arm;

(c) a third body joined to a free end of said transverse arm;

(d) said bodies each having a thickness substantially greater than the thickness of said frame and presenting flat upper and lower surfaces that are parallel to each other and that lie in the same planes as corresponding surfaces of the other bodies of said guide;

(e) said third body being spaced transversely on said guide from said first and second bodies a distance only slightly less than the width of one of said recessed face surfaces.

2. A guide according to claim 1, wherein said arms and bodies are formed of molded plastic material.

3. A guide according to claim 1, wherein said bodies are in the form of solid parallelepipedons.

4. A guide according to claim 1, wherein said bodies present, in corresponding surfaces, longitudinal extending grooves for receiving portions of reinforcing rods.

5. A guide according to claim 1, wherein first and second bodies are spaced longitudinally from each other a distance slightly greater than the length of said third body.

6. A one-piece guide adapted to be inserted into an adhesive compound, such as mortar, between recessed surfaces of predetermined width presented by opposing faces of adjacent units, such as glass blocks, to space and align said units with respect to each other in the formation of a masonry structure, said guide comprising:

(a) a frame including a longitudinal arm and at least one other arm angularly related to said longitudinal arm;

(b) a pair of first and second bodies joined to opposite ends of said longitudinal arm;

(c) a third body joined to a free end of said other arm;

(d) said bodies each having a thickness substantially greater than the thickness of said frame and presenting flat upper and lower surfaces that are parallel to each other and that lie in the same planes as corresponding surfaces of the other bodies of said guide;

(e) said third body being spaced transversely on said guide from said first and second bodies a distance only slightly less than the width of one of said recessed face surfaces.

7. A guide according to claim 6, wherein said arms and bodies are formed of molded plastic material.

8. A guide according to claim 6, wherein said bodies are in the form of solid parallelepipedons.

9. A guide according to claim 6, wherein said bodies present, in corresponding surfaces, longitudinally extending grooves for receiving portions of reinforcing rods.

10. A guide according to claim 6, wherein first and second bodies are spaced longitudinally from each other a distance slightly greater that the length of said third body.

11. A guide according to claim 6, wherein said frame is T-shaped and said other arm is joined to a medial portion of said longitudinal arm and extends normal thereto.

12. A guide according to claim 6, wherein said frame is generally triangular and includes three separate arms, each of which is joined at opposite ends to a pair of said bodies.

13. A guide according to claim 6, wherein said frame includes a pair of other arms joined at corresponding ends to said third body and at corresponding other ends to respective first and second bodies.

14. In a masonry structure, the combination of:

(a) a pair of adjacent building units, such as glass blocks, presenting opposing faces, each of which includes:

(i) a pair of transversely spaced, parallel side flanges extending substantially the entire length of said face at opposite sides of said face;

(ii) a relatively flat, generally rectangular, recessed surface of predetermined width extending substantially the entire length of said face between said flanges;

(b) a layer of adhesive compound, such as mortar, interposed between said units;

(c) a one-piece guide positioned in said compound between said unit faces to space and align said units with respect to each other, and comprising:

(i) a frame including a longitudinal arm and at least one other arm angularly related to said longitudinal arm;

(ii) a pair of first and second bodies joined to opposite ends of said longitudinal arm;

(iii) a third body joined to a free end of said other arm;

(iv) said bodies each having a thickness substantially greater than the thickness of said frame;

(v) said third body being spaced transversely on said guide from said first and second bodies a distance only slightly less than the width of one of said recessed face surfaces.

15. A guide according to claim 14, wherein said arms and bodies are formed of molded plastic material.

16. A guide according to claim 14, wherein said bodies are in the form of solid parallelepipedons.

17. A guide according to claim 14, wherein said bodies present, in corresponding surfaces, longitudinally extending grooves for receiving portions of reinforcing rods.

18. A guide according to claim 14, wherein first and second bodies are spaced longitudinally from each other a distance slightly greater that the length of said third body.

19. A guide according to claim 14, wherein said frame is T-shaped and said other arm is joined to a medial portion of said longitudinal arm and extends normal thereto.

20. A guide according to claim 14, wherein said frame is generally triangular and includes three separate arms, each of which is joined at opposite ends to a pair of said bodies.

* * * * *